US009105257B2

(12) United States Patent
Shamchuk

(10) Patent No.: US 9,105,257 B2
(45) Date of Patent: Aug. 11, 2015

(54) MAGNETIC GUITAR SLIDE HOLDER

(71) Applicant: David Alex Shamchuk, Edmonton (CA)

(72) Inventor: David Alex Shamchuk, Edmonton (CA)

( * ) Notice: Subject to any disclaimer, the term of this patent is extended or adjusted under 35 U.S.C. 154(b) by 1 day.

(21) Appl. No.: 14/256,951

(22) Filed: Apr. 19, 2014

(65) Prior Publication Data

US 2014/0331848 A1 Nov. 13, 2014

Related U.S. Application Data

(60) Provisional application No. 61/820,744, filed on May 8, 2013.

(51) Int. Cl.
*G10D 3/00* (2006.01)
*G10D 1/08* (2006.01)

(52) U.S. Cl.
CPC ... *G10D 3/00* (2013.01); *G10D 1/08* (2013.01)

(58) Field of Classification Search
CPC ..... G10D 3/163; G10D 3/00; G10D 13/006; G10D 1/005; G10D 1/04; G10D 1/08; G10D 3/043; G10D 3/146; G10D 3/16; B29L 2031/758
USPC ..... 84/320–322
See application file for complete search history.

(56) References Cited

U.S. PATENT DOCUMENTS 5,739,445 A * 4/1998 Terry et al. ..... 84/329
7,847,171 B1 * 12/2010 Kidd, III ..... 84/329

* cited by examiner

*Primary Examiner* — Kimberly Lockett
(74) *Attorney, Agent, or Firm* — Steven N. Fox, Esq.

(57) ABSTRACT

The present invention is a slide holder for use with a guitar having a headstock and a plurality of strings to support a slide. The slide holder comprises a housing comprising a top surface, a bottom surface, and first and second cavities extending inward from the top surface. The slide holder further comprises a first magnet disposed in the first cavity and a second magnet disposed in the second cavity. The slide holder can be placed upon the headstock and under the strings of the guitar to magnetically secure the slide to the strings thereby providing a support for the slide when not used.

19 Claims, 3 Drawing Sheets

MAGNETIC GUITAR SLIDE HOLDER

CROSS-REFERENCE TO RELATED APPLICATIONS

This application claims priority to U.S. Provisional Application Ser. No. 61/820,744 filed on May 8, 2013, now pending, which is hereby incorporated into this specification by reference in its entirety.

BACKGROUND OF THE INVENTION

FIG. 1 shows a conventional guitar 10 having a neck 12, a headstock 14, a plurality of tuning pegs 16, a nut 18, a plurality of strings 20, and a plurality of frets 22. FIG. 2 shows a conventional metal slide 30 in the shape of a cylinder. Slide 30 has open ends so the player's finger may be inserted into either end as desired. The notes on guitar 10 are selected when a player depresses one of the strings 20 using a finger applied against one of the frets 22. String 20 contacts fret 22 and the pitch is increased to sound the desired note. An alternative method of playing a note at the desired pitch is to use a slide 30. This is a cylinder made of metal, glass or ceramic that is worn over the player's finger. The player contacts neck 12 at the desired position with slide 30 to achieve the desired pitch without necessarily contacting frets 22. This method of play offers unique sounds, not achievable with finger contact on frets 22. Slide 30 is somewhat awkward and can be difficult to put on and remove while playing. This is sometimes required, as parts of a song, which may or may not require this technique of play. While slide 30 is being worn, the finger wearing slide 30 cannot be used to depress strings 20 on frets 22 and use of this finger is lost. An expedient means of wearing and removing slide 30 is of value to the guitarist.

SUMMARY OF THE INVENTION

The present invention is a slide holder for use with a guitar having a headstock and a plurality of strings to support a slide. The slide holder comprises a housing comprising a top surface, a bottom surface, and first and second cavities extending inward from the top surface. The slide holder further comprises a first magnet disposed in the first cavity and a second magnet disposed in the second cavity. The slide holder can be placed upon the headstock and under the strings of the guitar to magnetically secure the slide to the strings thereby providing a convenient support for the slide when not used.

BRIEF DESCRIPTION OF THE DRAWINGS

The following description of the invention will be further understood with reference to the accompanying drawings, in which.

DESCRIPTION OF THE INVENTION

Figure 1:
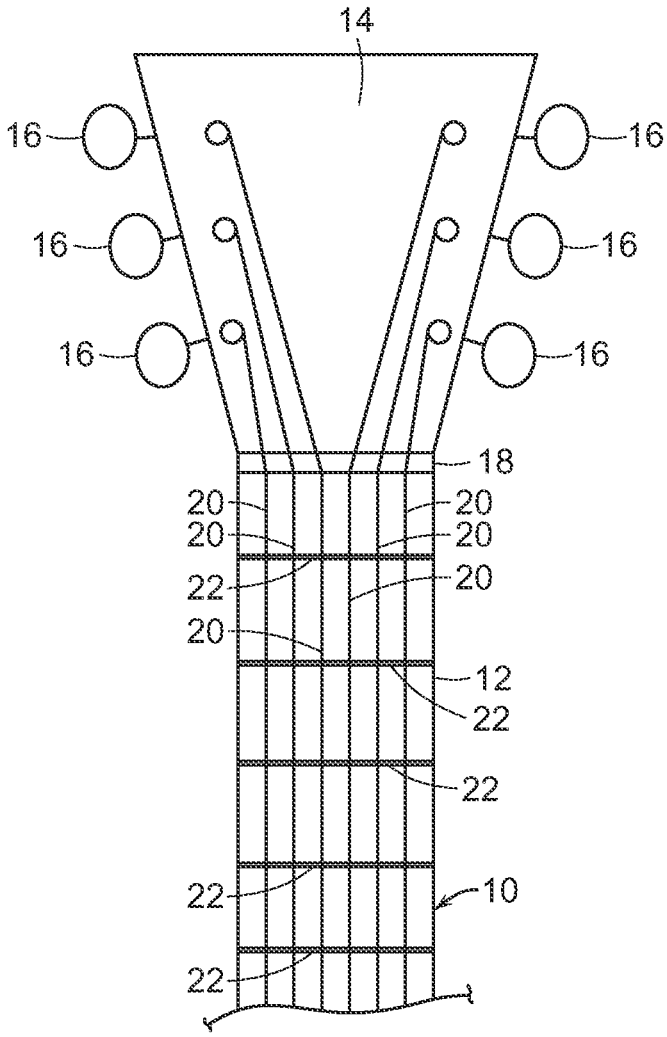
(PRIOR ART) FIG. 1
FIG. 1 is a top view of a conventional guitar having a neck, a headstock and a plurality of strings.
Figure 2:
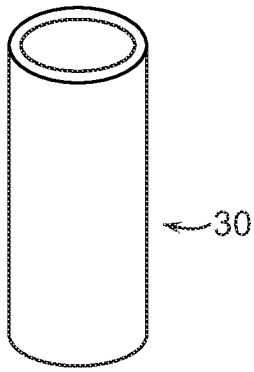
(PRIOR ART) FIG. 2
FIG. 2 is a perspective view of a conventional slide.
Figure 3:
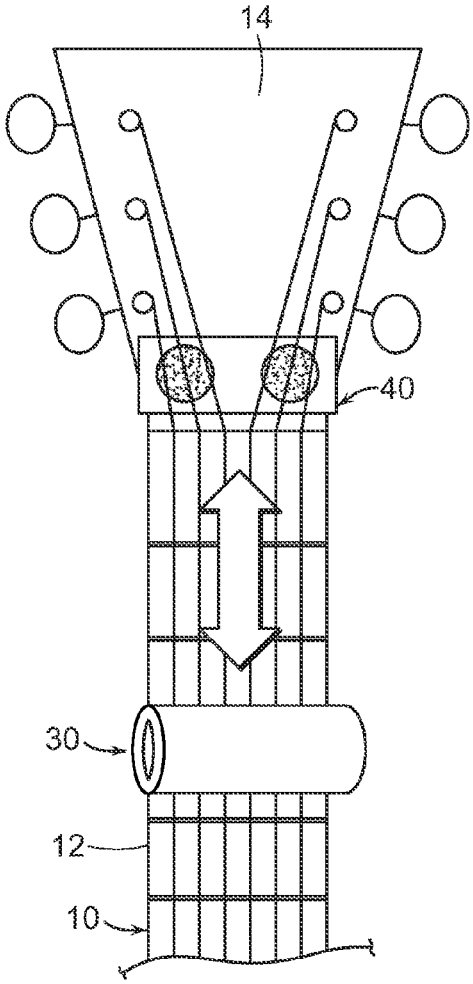
FIG. 3 is a perspective view showing a slide holder according to the present invention mounted on the headstock and under the strings of the guitar.

Referring to FIG. 3, a slide holder 40 according to the present invention is shown removably secured on a headstock 14 of a guitar 10. Slide holder 40 is adapted to be inserted on headstock 14 just above nut 18 and below strings 20. Slide holder 40 is further adapted to removably a secure slide 30 when desired by the player of guitar 10.

Figure 4:
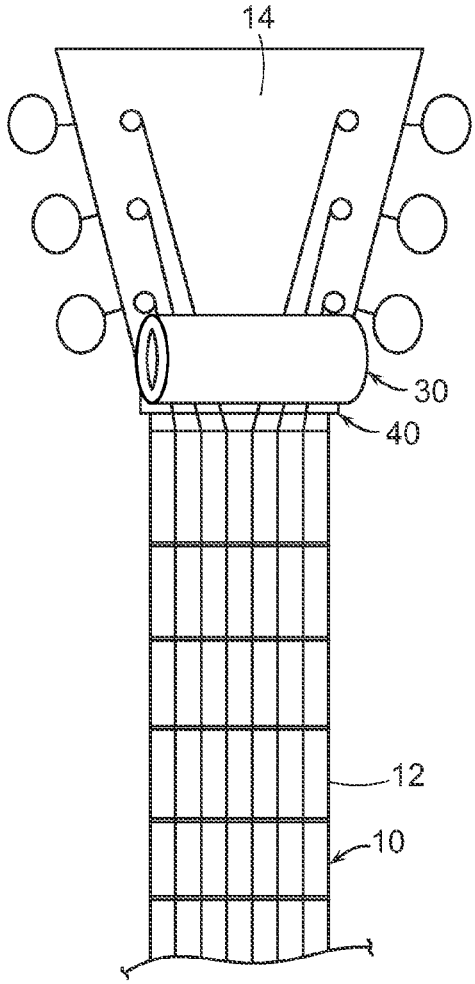
FIG. 4 is a perspective of the slide holder mounted on the headstock and under the strings of the guitar and a slide secured to and/or engaged with the strings directly above the slide holder.

Referring to FIG. 4, slide 30 is shown removably secured and/or engaged with strings 20 directly above slide holder 40 disposed on headstock 14 of guitar 10.

Figure 5:
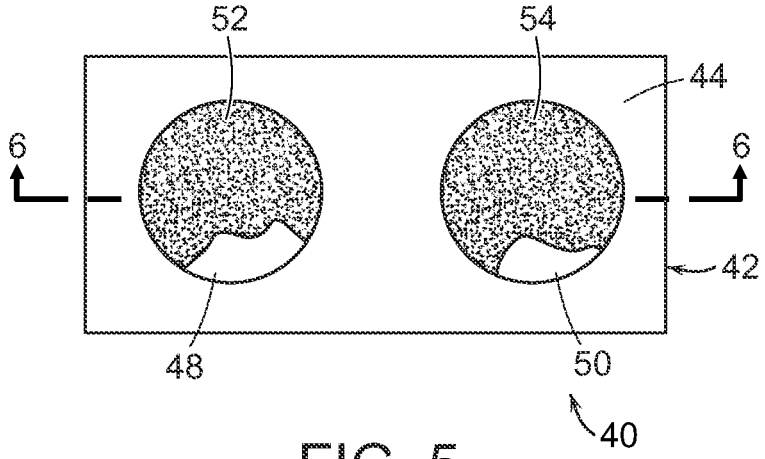
FIG. 5 is a top view of the slide holder.
Figure 6:
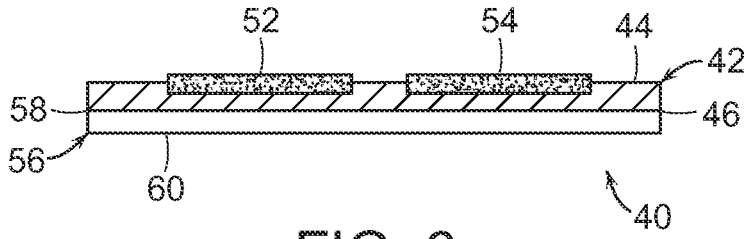
FIG. 6 is a cross section view of the slide holder taken along line 6-6 of FIG. 5.

Referring to FIGS. 5 and 6, slide holder 40 generally comprises a housing 42, magnets 52 and 54, and a removable adhesive pad 56. Housing 42 generally comprises a top surface 44, a bottom surface 46, a first cavity 48 and a second cavity 50 extending inward from top surface 44. Housing 42 is made from a compressible soft EVA foam available under the brand name POLYCELL from MDI Products, LLC, 10045 102nd Terrace, Sebastian, Fla. 32958 9 (www.mdiproducts.com), and fabricated by well known injection molding processes. In the embodiment shown, housing 42 is rectangular shaped. In other embodiments, housing 42 may take different shapes such as a circular shape.

Magnet 52 is secured in first cavity 48 by a conventional liquid adhesive. Similarly, magnet 54 is secured in second cavity 50 by a conventional liquid adhesive. Slide 30 is made of metal is removably attracted to magnets 52 and 54 of slide holder 40 as desired by the player of guitar 10. Magnets 52 and 54 have a sufficient magnetic field strength to secure slide 30 to or upon strings 20. In the embodiment shown, magnets 52 and 54 are neodymium magnets available from K&J Magnetics, Inc., 18 Appletree Lane, Pipersville, Pa. 18947 (www.kjmagnets.com). Although magnets 52 and 54 have been illustrated, slider holder 40 may comprise a single magnet of circular or rectangular shape or more than two magnets of different shapes. Alternatively, magnets 52 and 54 may be molded as part of housing 42.

Adhesive pad 56 is a double sided self-adhering stick pad made with nano-suction cups that can be secured to the surface of headstock 14 which is typically made of wood with a polymer thin film coating, ceramic, metal and/or a combination thereof. Adhesive pad 56 comprises a top surface 58 removably secured to bottom surface 46 of housing 42 and a bottom surface 60 that is secured to headstock 14. Adhesive pad 56 is well known and available from under the brand name STICK UM! from UM-BRANDS.COM, 13931 Central Avenue, Chino, Calif. 91710 (www.um-brands.com).

Figure 7:
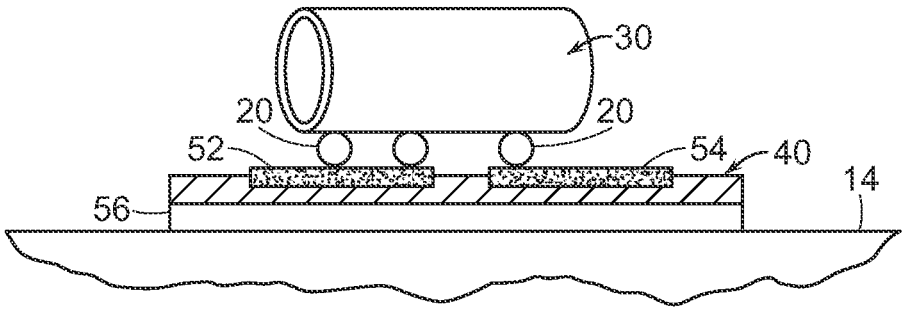
FIG. 7 is a cross section view showing the slide secured to and/or engaged upon the strings of the guitar directly above the slide holder mounted upon the head of the guitar.

Referring to FIG. 7, slide holder 40 is positioned under strings 20 and on headstock 14 of guitar 10. It is critical that slide holder 40 have an overall height in the range of 0.375 to 0.500 inches which allows slide holder 40 to be inserted on headstock 14 and under strings 20 of guitar 10. The compressibility of housing 42 provides height adjustment for insertion of slider holder 40 upon headtsock 14. Adhesive pad 56 stabilizes the position of slide holder 40 in relation to strings 20 and diminish any motion when in use. When slide 30 is placed in proximity to magnets 52 and 54 and released by the player, it remains suspended in a ready position under the magnetic field produced by magnets 52 and 54. The orientation and position are very favorable for reuse. When needed, the player inserts their finger into slide 30 and exerts enough force to remove it from the magnetic field of magnets 52 and

54. The strategic location and ease of movement on and off the finger make slide holder 40 a very useful tool.

The foregoing description is intended primarily for purposes of illustration. This invention may be embodied in other forms or carried out in other ways without departing from the spirit or scope of the invention. Modifications and variations still falling within the spirit or scope of the invention will be readily apparent to those of skill in the art.

What is claimed:

1. A slide holder for use with a guitar having a headstock and a plurality of strings to support a slide, the slide holder comprising:

a housing comprising a top surface, a bottom surface, and a first cavity extending inward from said top surface;

a pad engaged with said bottom surface; and a first magnet disposed in said first cavity; said first magnet magnetically secures the slider to the strings of the guitar upon placement of said housing upon the headstock and below the strings of the guitar.

2. The slide holder of claim 1, wherein said pad is removably engaged with said bottom surface.

3. The slide holder of claim 2, wherein said housing is made from a compressible material.

4. The slide holder of claim 3, wherein said housing has an overall height in the range of 0.375 to 0.500 inches so said housing can be inserted on the headstock and under the strings of the guitar.

5. The slide holder of claim 4, where said housing comprising a second cavity extending inward from said top surface.

6. The slide holder of claim 5, further comprising a second magnet disposed in said second cavity.

7. The device of claim 6, wherein each of said first and second magnets are circular shaped.

8. The device of claim 7, wherein said housing is rectangular shaped.

9. The slider holder of claim 8, wherein said pad comprises nano suction cups.

10. A musical system comprising:

a guitar comprising a head stock and a plurality of strings;

a slide holder secured to said headstock and disposed below said strings; said slide holder comprises a housing and a first magnet; said housing comprises a top surface, a bottom surface, and a first cavity extending inward from said top surface; said first magnet is disposed in said first cavity; and a slide removably secured to said strings of said guitar under the magnetic force of said first magnet.

11. The slide holder of claim 10, further comprising a pad engaged with said bottom surface of said slide holder.

12. The slide holder of claim 11, wherein said pad is removably engaged with said bottom surface.

13. The slide holder of claim 12, wherein said housing is made from a compressible material.

14. The slide holder of claim 13, wherein said housing has an overall height in the range of 0.375 to 0.500 inches so said housing can be inserted on the headstock and under the strings of the guitar.

15. The slide holder of claim 14, where said housing comprising a second cavity extending inward from said top surface.

16. The slide holder of claim 15, further comprising a second magnet disposed in said second cavity.

17. The device of claim 16, wherein each of said first and second magnets are circular shaped, and said housing is rectangular shaped.

18. The slider holder of claim 17, wherein said pad comprises nano suction cups.

19. A method of using a slide with a guitar having a headstock and a plurality of strings, the method comprising the steps of:

securing a slide holder to the headstock at a position below the strings; said slide holder comprises a housing and a first magnet; said housing comprises a top surface, a bottom surface, and a first cavity extending inward from said top surface; said first magnet is disposed in said first cavity;

securing the slide to the strings of the guitar above said slide holder under the magnetic force of said first magnet; and removing the slide from the strings of the guitar.

* * * * *